US005438154A

United States Patent [19]

Segan et al.

[11] Patent Number: 5,438,154

[45] Date of Patent: Aug. 1, 1995

[54] HOLIDAY ACTION AND MUSICAL DISPLAY

[75] Inventors: Marc H. Segan, New York, N.Y.; Michael R. Newsome, Newport, Va.; Gary Strauss, Mamaroneck, N.Y.

[73] Assignee: M. H. Segan Limited Partnership, Great Barrington, Mass.

[21] Appl. No.: 127,689

[22] Filed: Sep. 27, 1993

[51] Int. Cl.[6] ..... G10H 1/02; G04B 21/00

[52] U.S. Cl. ..... 84/600; 368/273; 446/298; 446/357

[58] Field of Search ..... 84/600, 2, 3; 368/75, 368/272, 273; 446/298, 303, 331, 332, 357–359

[56] References Cited

U.S. PATENT DOCUMENTS

| | | | |
|---|---|---|---|
| 4,209,938 | 7/1980 | Orenstein | 46/116 |
| 4,250,787 | 2/1981 | Segan et al. | 84/1.01 |
| 4,482,260 | 11/1984 | Fehrenbalher | 368/272 |
| 4,521,205 | 6/1985 | Spector | 446/302 |
| 4,824,416 | 4/1989 | Chun-Hoi et al. | 446/298 |
| 4,828,527 | 5/1989 | Spector | 446/302 |
| 4,857,030 | 8/1989 | Rose | 446/303 |
| 4,945,805 | 8/1990 | Hour et al. | 84/610 |
| 4,949,327 | 8/1990 | Forsse et al. | 369/58 |
| 4,953,212 | 8/1990 | Otsubo | 381/1 |
| 4,993,006 | 2/1991 | Oshima et al. | 368/231 |
| 5,047,998 | 9/1991 | Alzpwa et al. | 368/75 |
| 5,063,698 | 11/1991 | Johnson et al. | 40/124.1 |
| 5,108,341 | 4/1992 | DeSemet | 446/299 |

*Primary Examiner*—Vit W. Miska

*Attorney, Agent, or Firm*—Cohen, Pontani, Lieberman, Pavane

[57] ABSTRACT

A holiday action and musical display (10) comprising a plurality of separate display units (40, 42, 44, 46) electrically connected to a central control unit (12). Each display unit contains a figurine (147) resembling a character representation which is capable of being moved from a first position where the figurine is partially blocked from a user's view, to a second position where the figurine is visible to a user. The central control unit accesses several pluralities of stored sounds and phrases which are stored in electronic memory (305), with the sounds of each plurality having a common timbre distinct from the timbres of the other pluralities of sounds, and with each timbre being associated with a particular character representation. The accessed sounds are played on a speaker (12) and the central control unit synchronizes the movements of the figurines with the accessed sounds so that the figurines appear to be jointly singing one of a plurality of stored melodies.

31 Claims, 7 Drawing Sheets

305
310
315A
315D
320
325
330
300
VCC
U1
U5
U7
U9A
U9B
U9C
U9D
U16
AREF
XTAL1
XTAL2
RESET
INT1
INT2
ACT
STP3
STP2
STP1
ROW6
ROW5
ROW4
ROW3
ROW2
ROW1
FLASH
VO
DEN
TR10
TR9
TR8
TR7
TR6
TR5
TR4
TR3
TR2
TR1
MS1
MS2
OSC
LP1
LP2
SP1
T1
S1
S2
F1
F2

HOLIDAY ACTION AND MUSICAL DISPLAY

BACKGROUND OF THE INVENTION

I. Field of the Invention

This invention pertains to electromechanical decorative displays. More specifically, this invention pertains to sound and motion displays having synchronized sound and motion. Most particularly, this invention pertains to such displays capable of playing a plurality of holiday/Christmas melodies and suitable as Christmas ornaments.

II. Prior Art

A wide variety of Christmas ornamental displays exist. While some such displays incorporate music and/or light effects, a substantial market is perceived for a Christmas ornamental display wherein mechanical movement of a plurality of figurines is synchronized to several pluralities of sounds, each plurality having a common timbre, and wherein each timbre is associated with a figurine so that a visually pleasing display is created wherein the figurines appear to be acting in concert to sing one of a plurality of predetermined melodies.

It is an object of the present invention to provide a Christmas ornamental display of the aforementioned type wherein the mechanical movement comprises movement of a figurine from a position wherein a user's view of the figurine is obstructed, to a position where the figurine is visible, and wherein the corresponding sound is generated when the figurine is in its visible position.

It is still another object of the present invention to provide a Christmas ornamental display comprising a central control unit and a plurality of display units wherein each display unit comprises a distinct figurine and a pendulum and wherein the mechanical movement comprises separate movement of the pendulum and figurine.

It is yet a further object of the present invention to provide a Christmas display of the aforementioned type comprising means for suspending the display from the branches of a Christmas tree or, in the alternative, supporting the display on a flat surface.

SUMMARY OF THE INVENTION

Broadly speaking, the present invention relates to an ornamental musical action display comprising a control unit having a control circuit which generates first and second control signals and which is electrically connected to first and second display units. The control unit comprises sound generating means having a speaker, a first and second plurality of stored electrical signals corresponding to first and second pluralities of sounds in a plurality of pitches. A majority of the first plurality of sounds have a first timbre and a majority of the second plurality of sounds have a second timbre. A means is provided which is responsive to the first control signal for accessing the stored first and second pluralities of electrical signals for output to the speaker in a predetermined sequence for generating a melody. Each display unit comprises a housing and a member or figurine resembling a character representation associated with the first and second timbres, respectively, and first and second moving means for moving the first and second members between a first position, wherein an observer's view of the member is at least partially blocked, to a second position, wherein an observer's view of the member is unblocked. Each display unit also comprises drive means coupled to the first and second moving means and responsive to the second control signal for driving the first and second members between the first and second positions. The second control signal is timed relative to the first control signal for generating the first and second pluralities of sounds in coordination with movement of the first and second members, respectively, so that the first and second members appear to be jointly singing one of a plurality of stored melodies.

In the preferred embodiment, each display unit contains a pendulum connected to each moving means for pivotal movement relative to each pendulum's respective housing. In addition, each moving means is capable of bi-directional operation so that, when operated in a first direction, and depending on which moving means is addressed by the control unit, only the pendulums (either the first or second, or both) will move and, when the moving means are operated in the other direction, movement of any combination of the figurines and their respective pendulums can occur.

The foregoing as well as additional details of the present invention will be more fully apparent from the following detailed description and annexed drawings of the presently preferred embodiments thereof.

DETAILED DESCRIPTION OF THE PREFERRED EMBODIMENT

Figure 1:
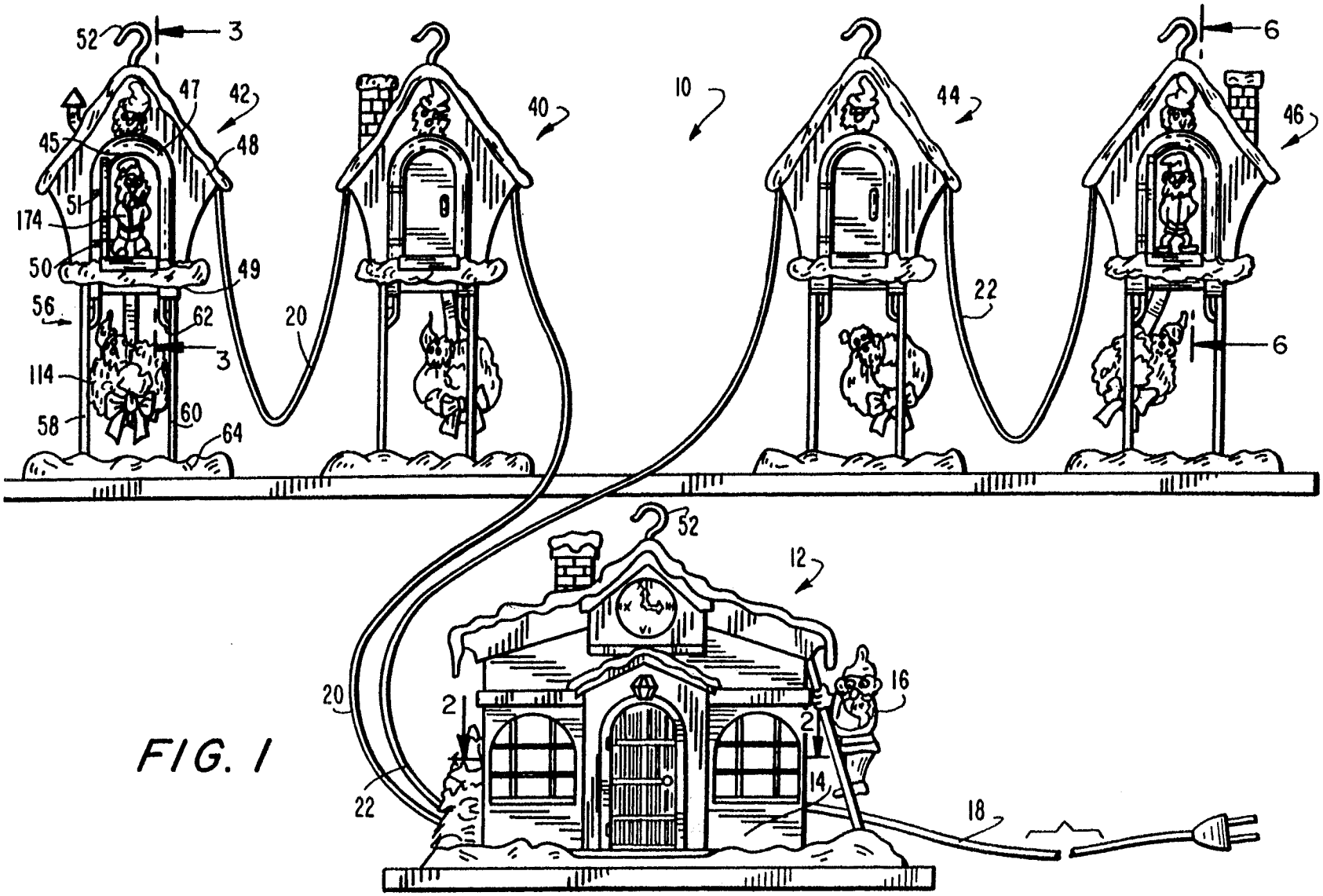
FIG. 1 is a perspective view of the display in accordance with the present invention shown displayed on a flat surface.

Referring now to the drawings and initially to FIG. 1, a preferred Christmas display 10 in accordance with the present invention is shown. Though display 10 is shown in FIG. 1 displayed on a flat surface, as will be apparent below, it may also be displayed on a Christmas tree. As shown, the display 10 includes a central control unit 12 which is connected via wire bundles 20, 22 to four display units 40, 42, 44 and 46. As shown, wire bundle 20 connects central control unit 12 to display units 40 and 42, and wire bundle 22 connects central control unit 12 to display units 44 and 46.

Figure 2:
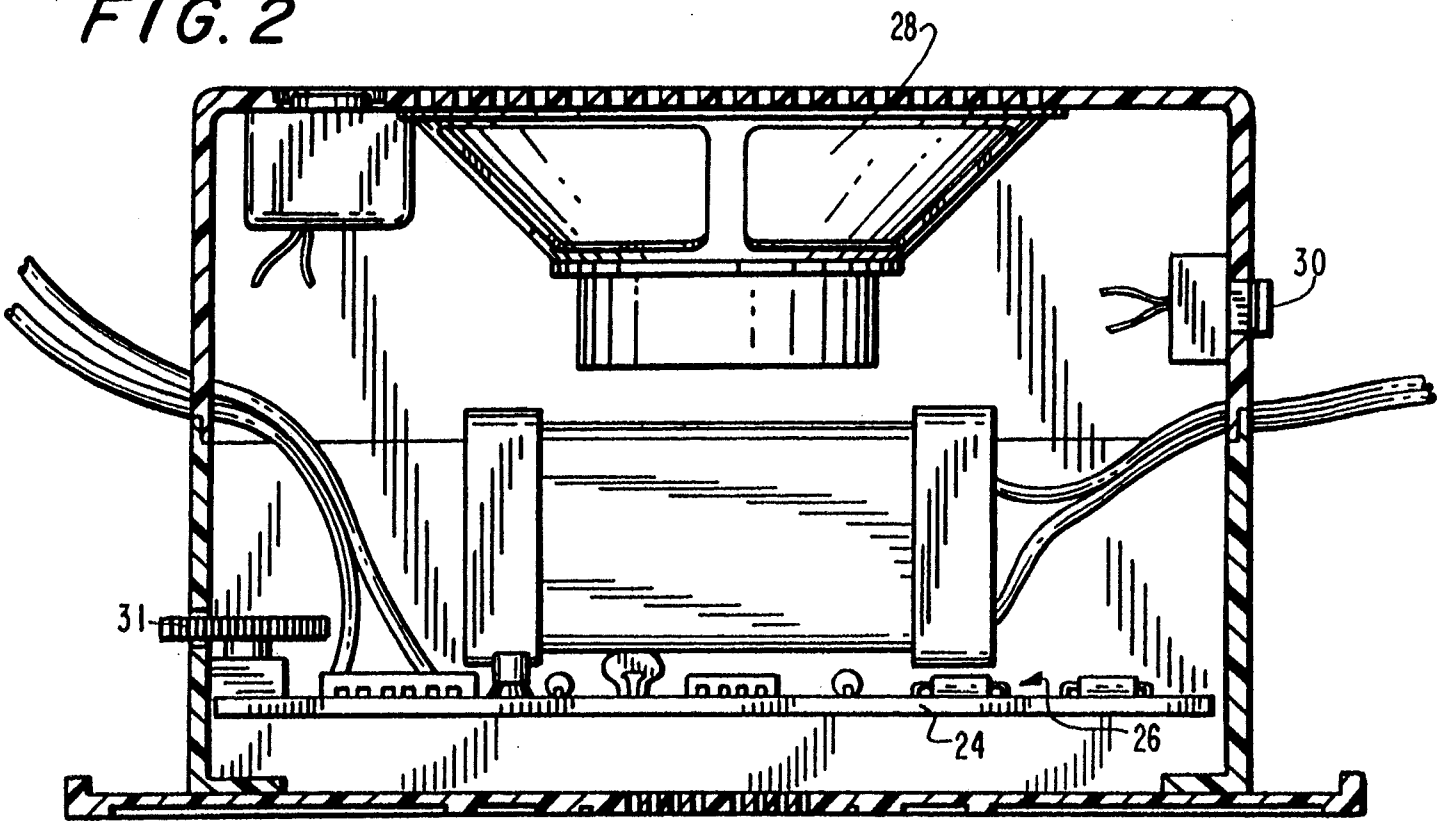
FIG. 2 is a cross-sectional view of the central control unit taken along the line 2—2 of FIG. 1.

Power to the control unit 12 is provided via a conventional power cord 18 having one end configured to mate with a standard electrical outlet (not shown). As shown in FIG. 2, the control unit 12 also comprises a circuit board 24 for a control circuit 26 electrically connected to a speaker 28 for generating sound, as more fully explained below. Control unit 12 also incorporates a song select button (not shown), an on/off power switch 30 and a volume dial 31, each of which is mounted, for easy manual access, on a decorative housing 14 which is preferably configured as a house having a Christmas theme. So, for example, decorative housing 14 may contain a figurine 16 resembling a snowman, Santa Claus, an elf, etc.

Wire bundle 20 includes three wires connecting control unit 12 to display unit 40. Of the three wires in wire bundle 20, two are address wires and one is a common ground. One address wire addresses display unit 40 and terminates therein and the other address wire passes through display unit 40 and addresses display unit 42. The ground wire is connected to both display units 40, 42. In a similar fashion, wire bundle 22 connects central control unit 12 to display units 44 and 46. As the display units 40, 42, 44, 46 are mechanically and electronically identical, only a description of display unit 42 will be given.

Figure 3:
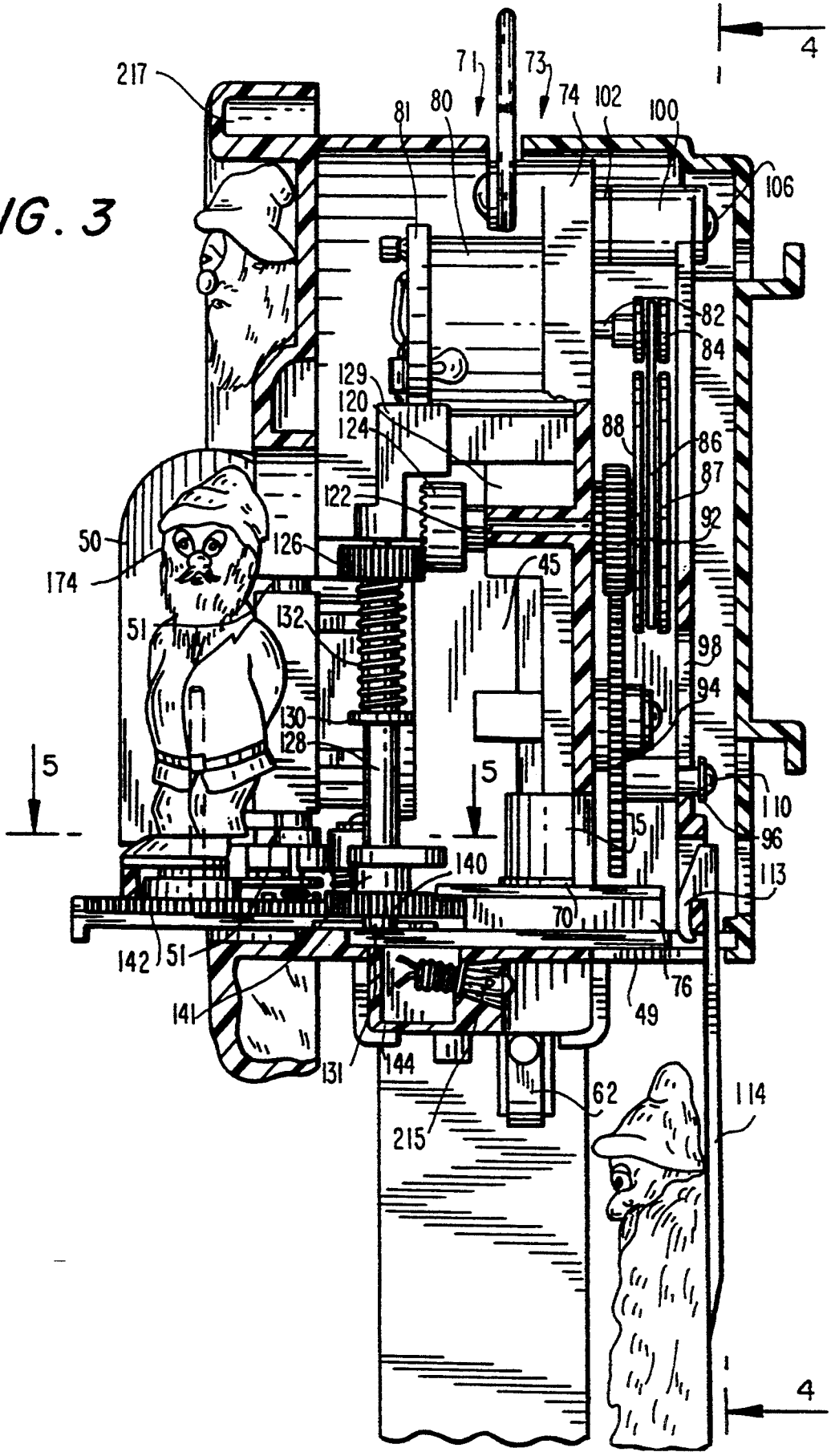
FIG. 3 is a cross-sectional view of the left-most display unit of FIG. 1 taken along the line 3—3 of FIG. 1 and showing the figurine in its extended position.
Figure 6:
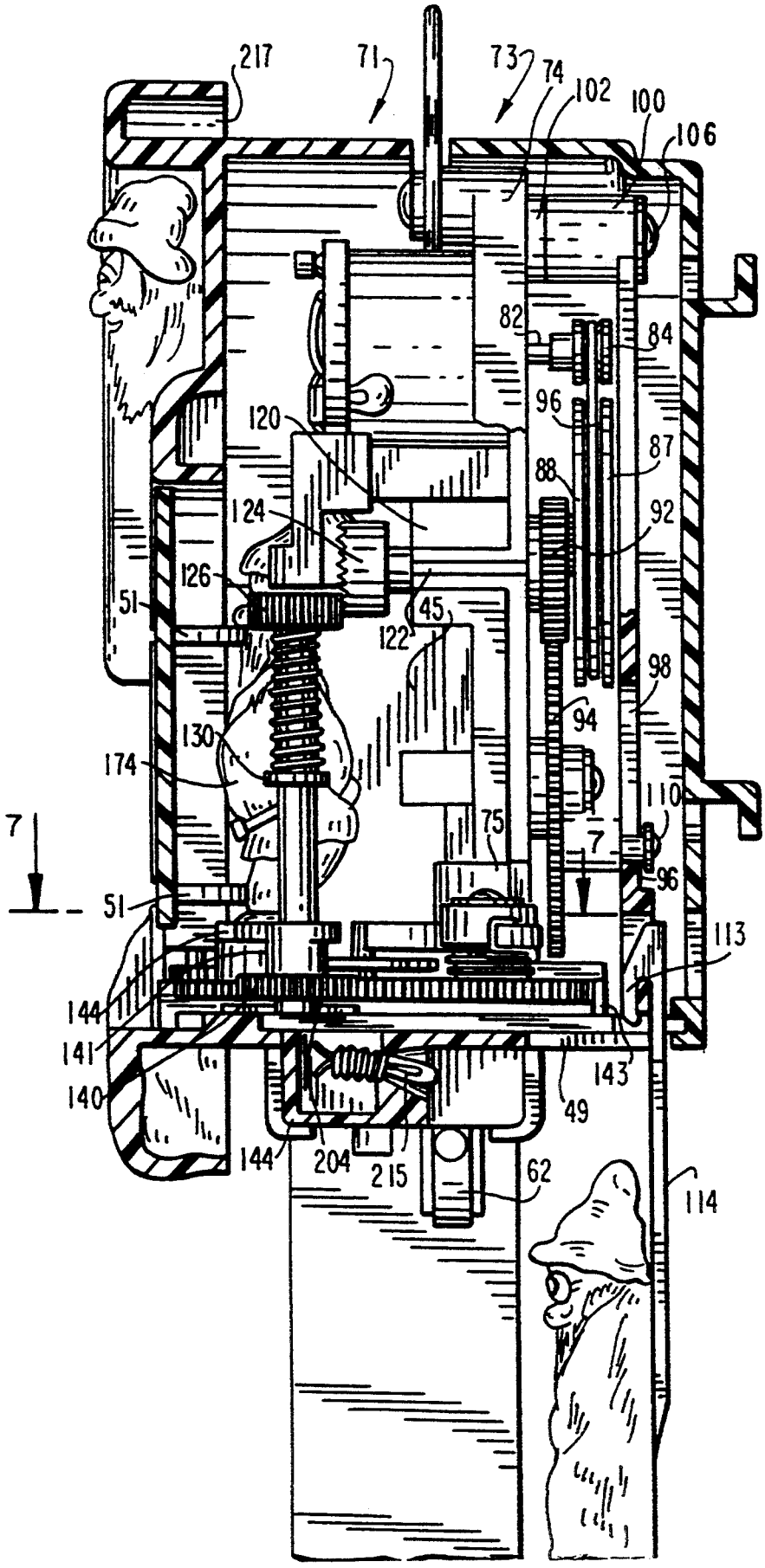
FIG. 6 is a cross-sectional view of the right-most display unit of FIG. 1 taken along the line 6—6 and showing the figurine in its retracted position.

Referring now to FIGS. 1, 3 and 6, display unit 42 comprises a housing 48 having a base 49. The front of housing 48 has an opening or doorway 47 communicating with a chamber 45 accommodating a member or figurine 174, the latter preferably comprising a recognizable character representation, such as a Disney character. A door 50 is hingedly secured to doorway 47 by a pair of hinges 51 for blocking and unblocking access to chamber 45. Display unit 42 also comprises a member resembling a pendulum 114 which is pivotally connected to housing 48, as more fully described below.

As shown in FIG. 1, display unit 42 incorporates a stand 56 comprising spaced vertical walls 58, 60 and a base 64 for elevating housing 48, thereby providing clearance for pendulum 114 when display unit 42 is exhibited on a flat surface. To accommodate assembly and disassembly of stand 56, the top of each wall 58, 60 incorporates a clip 62 configured for releasable securement in recesses (not shown) in the base 49 of housing 48. Similarly, the bottom of walls 58, 60 are configured for releasable securement in recesses in base 64. In lieu of display on a flat surface, each display unit 40, 42, 44, 46 may be suspended from, for example, a Christmas tree branch or a wall mounted hook, and for this purpose a hook 52 is provided at the top of each display unit and at the top of central control unit 12. When display 10 is suspended in this fashion, stands 56 are not required and may be removed.

Figure 4:
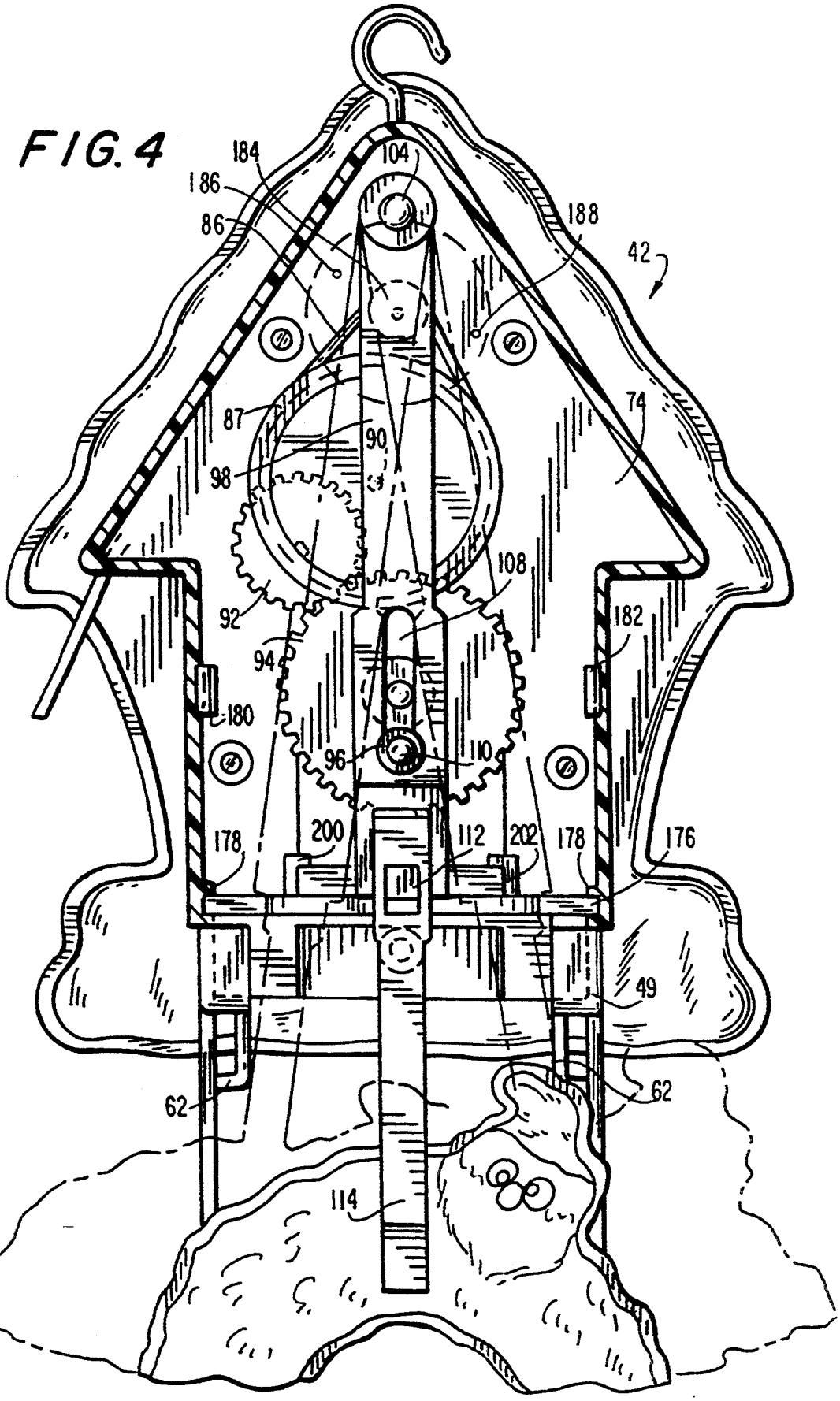
FIG. 4 is a cross-sectional view of the display unit of FIG. 3 taken along the line 4—4.

Referring now to FIGS. 3, 4 and 6, the internal components of display unit 42 will now be described. Housing 48 is comprised of a front section 71, a rear section 73, a support structure 74 and an inner base 76. The bottom of each section 71, 73 has an integrally formed inwardly extending protrusion defining a horizontal groove for receiving the edges of the inner base 76 for securing same in its proper position. Support structure 74 is secured to housing 48 by a pair of screws (not shown) which extend through a pair of short posts formed on inner base 76, the screws being received in threaded holes in a pair of base posts formed at the bottom of support structure 74. In FIG. 3, only one short post 70 and one base post 75 are shown, these being the right-most short post and base post as viewed from the front of display housing 48. It being understood that the other short post and base post are symmetrically positioned in the left side of the display 42. As best shown in FIG. 4, the front section 71 of the display housing 48 incorporates a pair of flanges 180, 182 each having a hooked end (not shown) for further securing support structure 74 in place.

Referring to FIGS. 3 and 4, support structure 74 has a hole 184 for receiving the drive shaft 82 of a bi-directional motor 80 mounted to the support structure 74 via screws 186, 188. The motor 80, which is controlled by control circuit 26 in a manner more fully described below, drives a small pulley 84 secured to the free end of drive shaft 82. The pulley 84, in turn, drives a larger pulley 87 via rubber drive belt 86. Large pulley 87, which is rotatably secured to support structure 74 via pin 90, incorporates a sprocket 88 for driving a small gear 92. Small gear 92, in turn, drives a large gear 94 rotatably mounted to support structure 74 via a screw. As best seen in FIGS. 3 and 4, a post or cam 96 is eccentrically mounted on the rear face of large gear 94. Integrally formed at the top of support structure 74 is a pivot post 102 dimensioned for mating inside a sleeve 100 formed at the top of a connecting rod 98. A screw 106 received in an internally threaded bore in pivot post 102 movably secures connecting rod 98 to pivot post 102, thereby creating a pivot point 104 about which connecting rod 98 swings back and forth relative to housing 48, as more fully explained below. The other end of connecting rod 98 defines a vertical slot 108 and a screw 110 extending through slot 108 joins connecting rod 98 to cam 96 whereby cam 96 drives connecting rod 98 as more fully described below. As shown in FIG. 4, connecting rod 98 has an opening 112 below vertical slot 108 for receiving a hooked end 113 of pendulum 114.

As should now be apparent, regardless of the direction of rotation of bi-directional motor 80, small pulley 84 drives large pulley 87 and sprocket 88 via drive belt 86 which, in turn, rotates small gear 92, thereby driving large gear 94. As large gear 94 rotates, its cam 96, which is secured to connecting rod 98 by screw 110, moves the lower end of connecting rod 98 from side to side about pivot point 104, thereby causing pendulum 114 to swing back and forth relative to display housing 48.

Referring now to FIGS. 3 and 5–7, small gear 92 is connected to a crown gear 124 via a shaft 122 extending through a bore in a post 120 integrally formed with support structure 74. As shown, crown gear 124 drives a gear 126 mounted on the upper end of a vertical shaft 128. Vertical shaft 128 is rotatably mounted between a brace 129, which is secured to support structure 74 by a screw, and a small post 131 integrally formed with inner base 76. As shown in FIGS. 3 and 6, shaft 128 has a radial shoulder or lip 130 which supports a biasing spring 132 between shoulder 130 and gear 126 for maintaining gear 126 in active engagement with crown gear 124. The lower end of shaft 128 also comprises a cam 14 which is coupled to a pinion 140 via a friction coupling 141, in a manner more fully described below.

Figure 5:
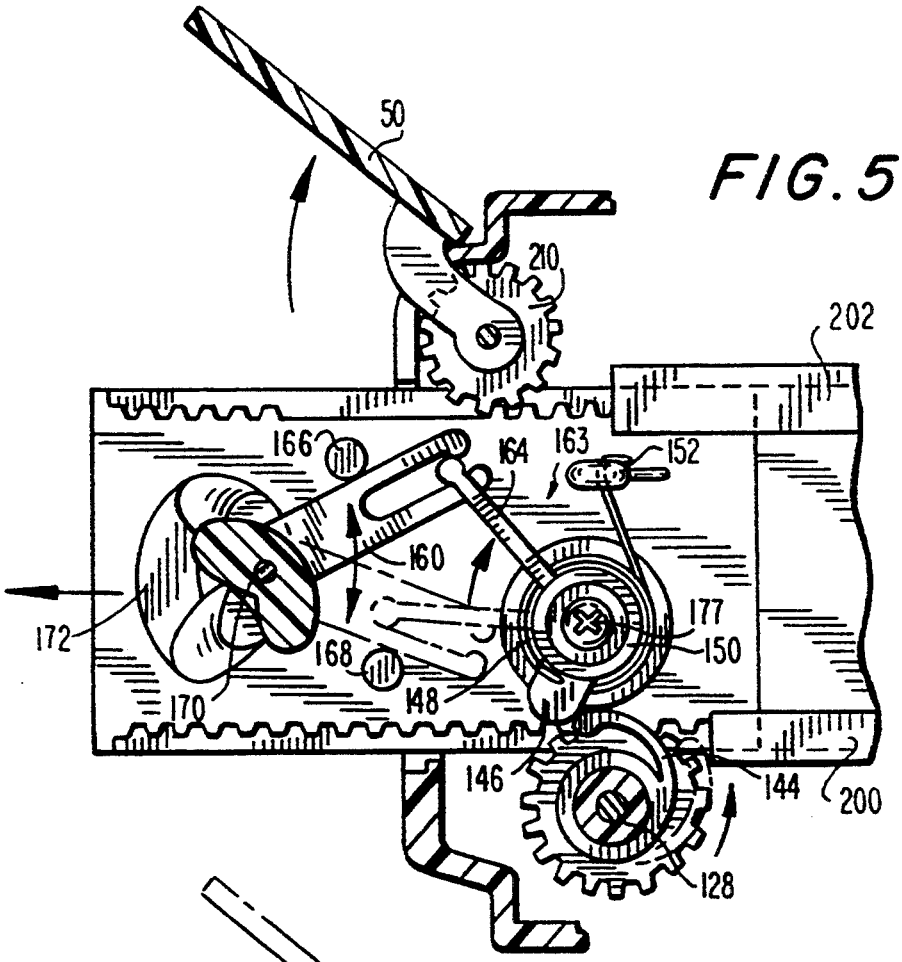
FIG. 5 is a cross-sectional view of the display unit of FIG. 3 taken along the line 5—5.
Figure 7:
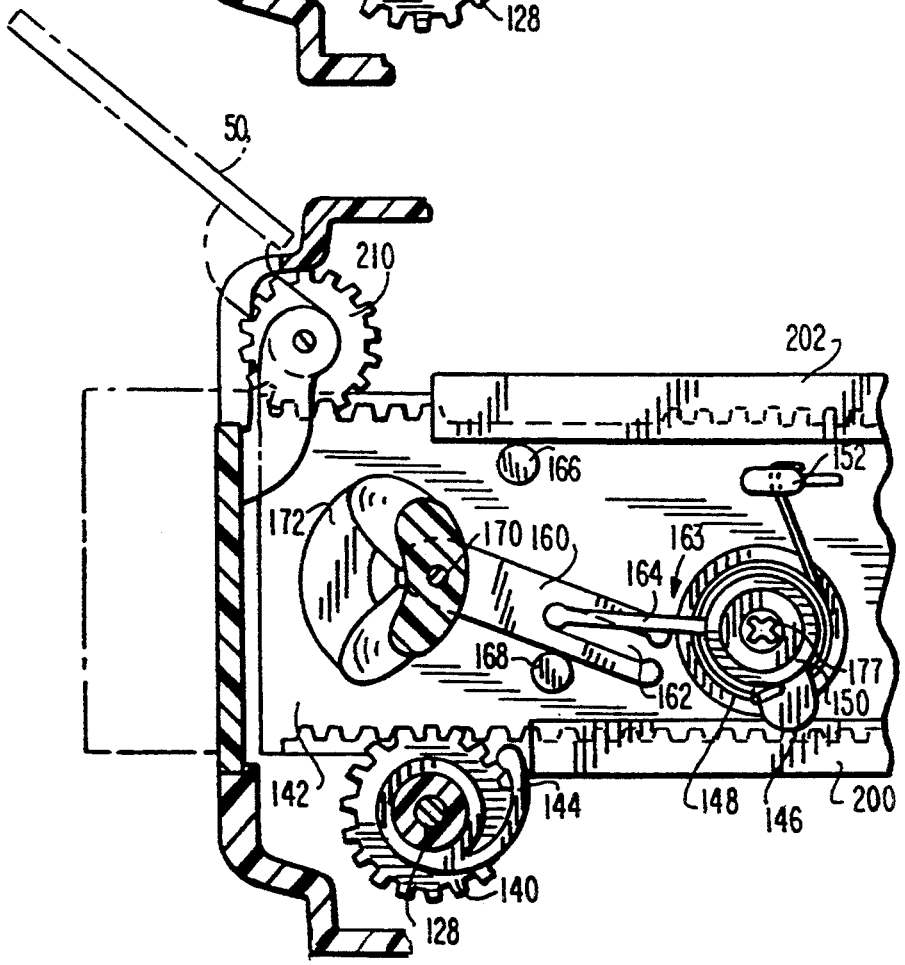
FIG. 7 is a cross-sectional view of the display unit of FIG. 6 taken along the line 7—7.

Still referring to FIGS. 3 and 5–7, each display unit 40, 42, 44 and 46 includes a figurine 174 moveable with respect to display housing 48. Each figurine comprises a different recognizable character representation having a separate voice or timbre associated therewith. For example, the figurines may comprise known cartoon characters, such as Bugs Bunny, Mickey Mouse, etc. Each figurine 174 is divided into two sections, a lower section which, in the preferred embodiment, may include either (i) the figurine's feet or (ii) the mid-torso and feet, and an upper section comprising the balance of the figurine. Of course, other divisions are possible. The lower portion of each figurine 174 is fixedly mounted to a figurine stand 172 and, as more fully explained below, the upper portion is mounted for rotation relative to the lower portion on a pin 170. Each figurine stand 172 is integrally formed with a rectangular shaped rack 142 aligned with pinion 140 for effecting translational movement of rack 142 in a direction perpendicular to the front of display housing 48 and, as best shown in FIGS. 5 and 7, the side edges of rack 142 are slidably received in a pair of parallel rails 200, 202 integrally formed with inner base 76 of housing 48. The rear edge of rack 142 comprises a depending ridge 143 (FIG. 6) which abuts a stop 204 on inner base 76 for defining the fully extended position of figurine stand 172.

Referring next to FIGS. 5 and 7, rack 142 has a spring support 150 integrally formed therewith for receiving a rotate spring 148. An L-shaped member 163 has an arm 164 at one end, a cam-follower 146 at the other end, and a sleeved mid-section configured for securement about spring support 150 for securement thereto via a screw 177. Rotate spring 148 is fastened between cam-follower 146 and an anchor peg 152 integral with rack 142, thereby biasing arm 164 in a quiescent predetermined position shown in FIG. 7. Rotate pin 170 is connected at its lower end to one end of a connecting member 160 having a slot 162 at its other end for receiving the free end of arm 164.

When bi-directional motor 80 is operated in a counter-clockwise direction, drive belt 86 is, likewise, driven in a counter-clockwise direction. As a result, crown gear 124 turns gear 126 and pinion 140 in a counter-clockwise direction, thereby driving rack 142 to the front of decorative housing 48. As rack 142 extends, door 50, which has a gear 210 mounted in active engagement with rack 142, swing opens about hinges 51 and figurine 174 emerges from chamber 45. When ridge 143 comes in contact with stop 204, which occurs when rack 142 is fully extended, the translational motion of rack 142 ceases, whereupon the upper portion of figurine 174 pivots relative to its lower portion in a manner described below.

Still referring to FIGS. 5 and 7, and as explained above, pinion 140 is frictionally coupled to shaft 128 by friction coupling 141 and, cam 144 is integral with and formed at the bottom of shaft 128. Thus, when bi-directional motor 80 is activated in a counter-clockwise direction, shaft 128 rotates, thereby simultaneously and uniformly rotating both cam 144 and pinion 140. As pinion 140 rotates, rack 142 along with figurine 174 which is mounted thereto, emerge from chamber 45, thereby opening door 50, in a manner described above. However, once ridge 143 comes in contact with stop 204, thereby blocking further movement of rack 142, friction coupling 141 disengages pinion 140 from shaft 128, thereby stopping rotation of pinion 140 as cam 144 continues to rotate with shaft 128. When rack 142 is in its fully extended position, cam-follower 146 is now in close proximity with cam 144 and, as cam 144 rotates, it periodically urges cam-follower 146 against the spring force of rotate spring 148. This, in turn, causes arm 164, the free end of which is confined within slot 162 in connecting member 160, to rotate about post 150 and move connecting member 160 (FIG. 5). As cam 144 rotates and releases cam-follower 146, the spring force of rotate spring 148 causes arm 164 and connecting member 160 to snap-back to their quiescent positions as shown in phantom in FIG. 5. As should now be apparent, when arm 164 moves, thereby causing connecting member 160 to move back and forth between anchor posts 166 and 168 which are integral with rack 142, the upper section of figurine 174 begins to pivot relative to the lower section thereof and will continue in this motion so long as bi-directional motor 80 is operated in the counter-clockwise direction.

When bi-directional motor 80 is operated in the clockwise direction, pinion 140, which recouples to shaft 128 via friction coupling 141, begins to rotate in a clockwise direction. This retracts rack 142 into cavity 45 and simultaneously withdraws cam-follower 146 from cam 144, thereby discontinuing pivoting motion of figurine 174. At the same time, door 50 is closed by gear 210 mounted in active engagement with rack 142. As shaft 128 continues to rotate in a clockwise direction, it retracts rack 142 until the rear-most edge of rack 142 abuts a protrusion (not shown) integrally formed with and upwardly extending from inner base 76 for defining the fully retracted position of rack 42. At this point, friction coupling 141 again disengages pinion 140 from shaft 128. Although cam 144 continues to rotate in a clockwise manner along with shaft 128, it no longer effects the pivotal motion of figurine 174 (which, in any event, would not be visible as door 50 is now closed) because cam 144 is no longer in close proximity with cam-follower 146. It should be apparent, however, that regardless of the direction in which bi-directional motor 80 is operated, pendulum 114 continues to swing back and forth about pivot point 104.

Figure 8:
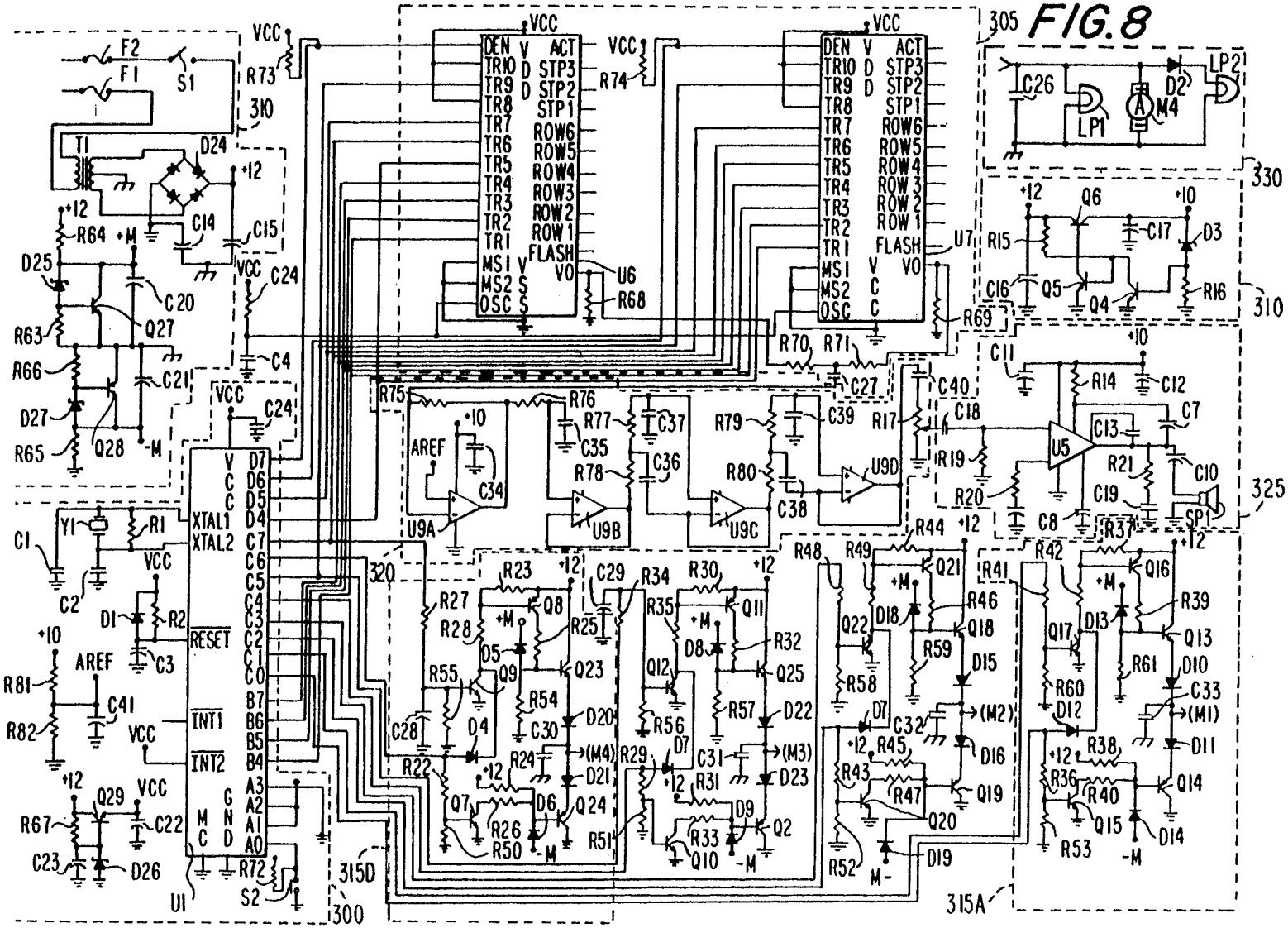
FIG. 8 is a schematic diagram of the control circuit incorporated in the present invention.

Referring again to FIGS. 3 and 6, the visually pleasing effect of the preferred embodiment of the display 10 is enhanced by the inclusion in each display unit 40, 42, 44 and 46, of two light bulbs 215, 217, the first (215), shown as LP1 in FIG. 8, being received in a socket within the base 49 and the second (217), shown as LP2 in FIG. 8, being received in a socket above doorway 47. Light bulbs 2 15, 217 are, in turn, connected to control circuit 26 by a motor/light circuit shown in the circled portion labelled 330 in FIG. 8, such that, when bi-directional motor 80 is operated in a clockwise direction wherein pendulum 114 moves, only light bulb 215 is illuminated but, when bi-directional motor 80 is operated in the counter-clockwise direction, thereby causing figurine 174 and pendulum 114 to move, both light bulbs 215 and 217 are illuminated. When bi-directional motor 80 is no longer energized, both light bulbs 215, 217 turn off.

Referring now to FIG. 8, a description of control circuit 26 will now be given. Control circuit 26 includes a controller 300 which controls the selection of the plurality of sounds stored in a memory means 305. In response to the controller 300, the output of memory means 305 is filtered by a low-pass filter circuit 320 and is amplified by amplifier circuit 325 for output by speaker SP1 (shown as speaker 28 in FIG. 2). The controller 300 also controls motor circuit 315 comprising four identical bi-directional motor driving circuits 315A–315D, each for driving a corresponding motor/light circuit 330.

The control circuit 26 is supplied with the appropriate voltages and currents by a conventional power supply 310. The power supply 310 comprises a power switch S1 (shown as switch 30 in FIG. 2) for energizing or de-energizing the power supply 310. In particular, power supply 310 provides motor driving voltages +M to bi-directional motor driving circuits 315A–315D. Since the power supply 310 is of conventional design, a detailed description of its construction and mode of operation is deemed unnecessary.

As presently preferred, controller 300 is implemented by microprocessor U1 and peripheral components comprising resistors R1, R2, R67, R72, R81, R82, capacitors C1, C2, C3, C22, C23, C24, C41, diodes D1, D26, crystal Y1, transistor Q29 and song select button shown as switch S2. Microprocessor U1 stores and provides the addresses (output pins B4–B7, C5, C7 and D4–D7) of the selected sounds to be read out from memory means 305 and supplies control signals (output pins C0–C7) to motor circuits 315A–315D.

In the preferred embodiment, the memory means 305 comprises two sound circuits U6 and U7. The two sound circuits U6 and U7 contain digital data representing four separate pluralities of sounds, comprising "la las" and "fa las" etc., as well as several words and phrases, with the sounds in each plurality sharing a common timbre or voice. The sounds are stored in the sound circuits U6 and U7 in a conventional manner so that a portion of each plurality of sounds is stored on each sound circuit U6 and U7, thereby permitting the corresponding voices for any combination of figurines to be activated. Microprocessor U1 sequentially provides the addresses to retrieve the appropriate sounds from sound circuits U6 and U7 to play one of a plurality of songs/melodies. In response to microprocessor U1, sound circuits U6 and/or U7 convert the digital data representing the selected sounds to an analog signal. The analog signal is filtered by low-pass filter circuit 320 to filter out the high frequency components of the analog converted digital data and is then amplified by amplifier circuit 325 for output by speaker SP1. As preferably constructed, low-pass filter circuit 320 comprises four operational amplifiers U9A–U9D.

The amplifier circuit 325 comprises amplifier U5 and volume potentiometer R17 which is in mechanical engagement with volume dial 31 (FIG. 2) for adjusting the volume of the selected melody. The amplifier circuit 325 further comprises resistors R14, R19, R20, R21, and capacitors C7, C8, C11, C12, C13, C18 and C19. As noted above, the amplified analog signal from amplifier circuit 325 is outputted to speaker SP1.

As shown in FIG. 8, the microprocessor U1 further controls each of the four bi-directional motor driving circuits 315A–315D which outputs signals M1–M4, respectively, to an associated motor/light circuit 330. Motor/light circuit 330 comprises motor M4, which corresponds to motor 80 in FIGS. 3–6 and which is responsive to signal M4 of motor driving circuit 315D, lamp LP1 which corresponds to light bulb 215, lamp LP2 which corresponds to light bulb 217, capacitor C26 and diode D2.

As will be apparent to one of ordinary skill in the art, since circuits 315A–315D are identical, only circuit 315D will be discussed in detail below. As constructed, bi-directional motor driving circuit 315D provides an output M4 of zero volts when the input from pins C6 and C7 of microprocessor U1 are low. As such, neither lamp LP1 nor LP2 is illuminated and motor M4 does not rotate. When the input to bi-directional motor driving circuit 315D from pins C6 is high and C7 is low, an output voltage of −M is provided to motor driving circuit 315D, which in turn drives motor M4 in the clockwise direction and illuminates lamp LP1. Alternatively, when the input to bi-directional motor driving circuit 315D from pins C6 is low and C7 is high, an output voltage of +M is provided to motor driving circuit 315D which, in turn, drives motor M4 in the counter-clockwise direction and illuminates lamps LP1 and LP2.

The currently preferred values for the components of control circuit 26 are given as follows:

| Item | Quantity | Reference | Part |
|---|---|---|---|
| 1 | 1 | C1 | 82P |
| 2 | 1 | C2 | 27P |
| 3 | 1 | C3 | 4U7 |
| 4 | 1 | C4 | 56P |
| 5 | 2 | C7, C10 | 47OU |
| 6 | 1 | C8 | 47U |
| 7 | 8 | C9, C11, C17, C20, C21, C22, C41, C42 | 100U |
| 8 | 14 | C12, C16, C18, C19, C24, C26, C27, C30, C31, C32, C33, C34, C40, C43 | 100N |
| 9 | 1 | C13 | 470P |
| 10 | 2 | C14, C15 | 1000U |
| 11 | 1 | C23 | 10U |
| 12 | 1 | C35 | 4N7 |
| 13 | 1 | C36 | 1N2 |
| 14 | 1 | C37 | 150P |
| 15 | 1 | C38 | 6N8 |
| 16 | 1 | C39 | 51P |
| 17 | 14 | D1, D2, D4, D5, D6, D7, D8, D9, D12, D13, D14, D17, D18, D19 | 1N4148 |
| 18 | 1 | D3 | 9V1 |
| 19 | 8 | D10, D11, D15, D16, D20, D21, D22, D23 | 1N4001 |
| 20 | 1 | D24 | BRIDGE |
| 21 | 2 | D25, D27 | 3V9 |
| 22 | 1 | D26 | 5V6 |
| 23 | 2 | F1, F2 | 1A |
| 24 | 2 | LP1, LP2 | 4VLAMP |
| 25 | 1 | M1 | MOTOR |
| 26 | 11 | Q4, Q5, Q7, Q9, Q10, Q12, Q15, Q17, Q20, Q22, Q27 | NPN |
| 27 | 5 | Q6, Q14, Q19, Q24, Q26 | PNP PWR |
| 28 | 5 | Q8, Q11, Q16, Q21, Q28 | PNP |
| 29 | 5 | Q13, Q18, Q23, Q25, Q29 | NPN PWR |
| 30 | 1 | R1 | 1M |
| 31 | 1 | R2 | 22K |
| 32 | 1 | R14 | 56 |
| 33 | 6 | R15, R64, R65, R90, R91, R92 | 1K |
| 34 | 2 | R16, R84 | 560R |
| 35 | 1 | R17 | 10K POT |
| 36 | 32 | R19, R23, R24, R28, R30, R31, R35, R37, R38, R42, R44, R45, R49, R54, R55, R56, R57, R58, R59, R60, R61, R72, R73, R74, R81, R82, R85, R86, R87, R88, R93, R94 | 10K |
| 37 | 1 | R20 | 120R |
| 38 | 1 | R21 | 1R |
| 39 | 7 | R22, R29, R36, R41, R43, R48, R67 | 2K2 |
| 40 | 8 | R25, R26, R32, R33, R39, R40, R46, R47 | 270R |
| 41 | 2 | R27, R34 | 2K7 |
| 42 | 4 | R50, R51, R52, R53 | 1K5 |
| 43 | 3 | R62, R70, R71 | 33K |
| 44 | 2 | R63, R66 | 330R |
| 45 | 2 | R68, R69 | 470R |
| 46 | 1 | R75 | 100K |
| 47 | 1 | R76 | 36K |
| 48 | 2 | R77, R78 | 180K |
| 49 | 2 | R79, R80 | 82K |
| 50 | 1 | R83 | 100R |
| 51 | 1 | R89 | 150K |
| 52 | 1 | S1 | SW SPST |
| 53 | 1 | S2 | METAL DOME |
| 54 | 1 | SP1 | 40hm |
| 55 | 1 | T1 | 12 VCT 1 A |
| 56 | 1 | US | KA2201/N |
| 57 | 2 | U6, U7 | HM2069 |
| 58 | 1 | U1 | TMS7000-40 |
| 59 | 1 | U9 | LM324 |

-continued

| Item | Quantity | Reference | Part |
|---|---|---|---|
| 60 | 1 | 5MHZ | Y1 |

The operation of control circuit 26 is as follows. To start the display 10, switch S1 is depressed. The microprocessor U1 now addresses each bi-directional motor 80 in each display unit 40, 42, 44 and 46 by outputting the proper signal along the address lines C0–C7 in wire bundles 20, 22. Thus, for example, if only the pendulum 114 of display unit 42 is to be moved, the output signal at pin C6 is set high and the output signal to pin C7 is set low. In this fashion, transistor Q7 is switched on such that signal M4 is set to a value of approximately −M volts, thereby causing bi-directional motor 80 to operate in a clockwise direction. As a result, pendulum 114 swings relative to display housing 48 in a manner described above and also light bulb 215 is illuminated. If, on the other hand, figurine 174 is to be moved, microprocessor U1 provides a low output at pin C6 and a high output at pin C7. As such, transistor Q7 is turned off and transistor Q9 is turned on causing signal M4 to be set to approximately +M volts which results in bi-directional motor 80 rotating in a counter-clockwise direction. As bi-directional motor 80 operates in the counter-clockwise direction, pendulum 114 and figurine 174 move in a manner described more fully above. Moreover, in this situation both light bulbs 215 and 217 are illuminated.

As explained above, the outputs of the microprocessor U1 are also connected to sound circuits U6 and U7. As is presently preferred, simultaneously with providing the appropriate signals to pins C0–C7, microprocessor U1 also provides the appropriate signals to output pins B4, B5, B6, B7, C5, C7, D4, D5, D6, and D7 which access memory 305 to cause the selected sounds to be outputted in a manner described above. Thus, and as should by now be apparent to one of ordinary skill in the art, the microprocessor U1 synchronizes the motion of the figurines 147 with the outputted sounds for creating the appearance that the outputted sounds emanate from the selected figurines. As the microprocessor U1 is capable of simultaneously accessing more than one bi-directional motor 80, the visual effect of the display 10 is enhanced because several figurines 147 and pendulums 114 can move simultaneously.

As presently configured, the microprocessor U1 outputs the sequences for the plurality of melodies in a fixed order. In other words, each time the display 10 is turned on, melodies are played in the same sequence. Thus, for example, if the display 10 is capable of playing five melodies, when activated, the display 10 would play the first melody followed by the second melody and so on. Thus, if a user is interested in hearing only the fifth melody, the user would be required to allow the four prior melodies to play before the fifth melody begins. To alleviate this problem, the preferred embodiment of the display 10 is equipped with a song select button (shown as S2 in FIG. 8) which is located on the back of decorative housing 14 of control unit 12. Each time the song select button is pressed, the microprocessor U1 skips the playing of the currently selected melody and begins to play the next melody. Thus, for example, the song select button would be pressed four times to start the fifth melody.

Having now described in detail the overall operation of the display 10, a brief overview will now be given. When power switch 30 is turned on, thereby connecting display 10 to a power source, such as an electrical outlet, microprocessor U1 begins outputting electrical signals in a predetermined sequence to bi-directional motor driving circuits 315A–315D so that bi-directional motors 80 will operate either in a clockwise or a counter-clockwise direction. If operated in a clockwise direction, only the respective pendulums 114 will pivot relative to their respective display housings 48. However, if operated in a counter-clockwise direction, both the corresponding figurines 174 and pendulums 114 move in a manner described above. When operated in a counter-clockwise direction, the corresponding figurines 174 emerge from their respective doorways 47 and pivot in a manner described above. Simultaneously, the microprocessor U1 accesses sound circuits U6 and U7 for outputting a melody in the voices corresponding to the particular figurines 174 which have been activated. As a result, an appearance is created that the selected figurines are singing, in concert, and each in its own voice, the selected melody. Accordingly, the display 10 creates a pleasing visual effect wherein the figurines appear to be singing in concert to "perform" one of a plurality of melodies and, the "performance" may comprise unison singing by two or more figurines and/or one particular figurine singing the "lead" part and the remaining figurines singing the "background" part.

Although I have herein shown and described the preferred embodiment of the invention, various changes and modifications will be readily apparent to those of ordinary skill in the art who read the foregoing description. For example, a microprocessor with extended memory capabilities may be utilized thereby further increasing the melody selection. In addition, although the control circuit 26 is shown using discrete components, those skilled in the art may recognize that these components can be easily replaced with a variety of alternative components and/or custom designed integrated circuits which achieve the same functionality. Also, additional display units with additional character representations may be added which would further enhance the pleasing visual effect of the display. Furthermore, movements of the figurines 174, other than the pivotal and translational movements described above, may be contemplated. As these as well as further changes and modifications are intended to be within the scope of the present invention, the foregoing description should be construed as illustrative and not in a limiting sense, the scope of the invention being defined by the following claims.

I claim:

1. An ornamental musical action display comprising:

(A) a control unit including;

(1) a control circuit for generating first and second control signals;

(2) sound generating means electrically connected to said control circuit for generating sound in response to said first control signal, said sound generating means comprising (a) a speaker;

(b) a first plurality of stored electrical signals corresponding to a first plurality of sounds in a plurality of pitches, wherein a majority of said first plurality of sounds have a first timbre;

(c) a second plurality of stored electrical signals corresponding to a second plurality of sounds in a plurality of pitches, wherein a majority of said second plurality of sounds have a second timbre;

(d) means for accessing said stored first and second pluralities of electrical signals for output to said speaker in a predetermined sequence for generating a melody;

(B)a first housing;

(C) a first member connected to said first housing and comprising a representation of a first character associated with said first timbre;

(D) a first moving means movable between first and second positions for at least partially blocking and unblocking an observer's view of said first member, respectively;

(E) a second housing;

(F) a second member connected to said second housing and comprising a representation of a second character associated with said second timbre;

(G) a second moving means movable between first and second positions for at least partially blocking and unblocking the observer's view of said second member, respectively; and (H) drive means coupled to said first and second moving means and responsive to said second control signal for driving said first and second moving means between said first and second positions, said second control signal being timed relative to said first control signal for generating said first and second pluralities of sounds in coordination with movement of said first and second moving means, respectively, between their respective first and second positions.

2. The display according to claim 1, wherein said sound generating means further comprises a third plurality of stored electrical signals corresponding to a third plurality of sounds in a plurality of pitches, wherein a majority of said third plurality of sounds have a third timbre, and wherein said means for accessing said stored first and second pluralities of electrical signals comprises means for accessing said stored first, second and third pluralities of electrical signals for outputting said first, second and third pluralities of electrical signals to said speaker in a predetermined sequence; and further comprising a third housing, a third member connected to said third housing and comprising a representation of a third character associated with said third timbre, a third moving means movable between first and second positions for at least partially blocking and unblocking an-observer's view of said third member, respectively, and responsive to said second control signal for moving said third moving means between said first and second positions, said second control signal being timed relative to said first control signal for generating said first, second and third pluralities of sounds in coordination with movement of said first, second and third moving means, respectively, between their respective first and second positions.

3. The display of claim 2, wherein said means for accessing said stored first second and third pluralities of electrical signals comprises means for simultaneously outputting at least two of said stored first, second and third pluralities of electrical signals to said speaker in a predetermined sequence whereby at least two of said first, second and third character representations appear to be singing simultaneously.

4. The display of claim 1, wherein said first and second moving means are coupled to said first and second members, respectively, and said first positions of said first and second moving means comprises a retracted position of said first and second members relative to their respective housings so that said first and second members are at least partially blocked from a user's view, and wherein said second positions of said first and second moving means comprises an extended position of said first and second members relative to their respective housings so that said first and second members are not blocked from the user's view.

5. The display of claim 4, wherein said first plurality of electrical signals is outputted to said speaker only when said first character representation is in its extended position and wherein said second plurality of electrical signals is outputted to said speaker only when said second character representation is in its extended position.

6. The display of claim 5, wherein said means for accessing said stored first and second pluralities of electrical signals comprises means for simultaneously outputting, at least some of the time, said first and second pluralities of electrical signals to said speaker in a predetermined sequence whereby said first and second character representations appear to be singing simultaneously.

7. The display of claim 4, wherein said drive means comprises a first drive means secured to said first housing for moving said first member and a second drive means secured to said second housing for moving said second member.

8. The display of claim 7, wherein each of said first and second housings defines a cavity, and wherein each of said first and second members is received in said cavity in its respective housing in its retracted position.

9. The display of claim 8, wherein said first and second drive means includes means for moving each of said first and second members in a repetitive motion after said first and second members are moved to their respective extended positions.

10. The display of claim 8, wherein each of said first and second housings includes a door hingedly secured about an opening accessing its respective cavity, each door being movable between a first position wherein its respective opening is closed by said door for at least partially blocking the user's view of said first and second members and a second position wherein said opening is exposed for exposing said first and second members.

11. The display of claim 10, wherein said first and second members move their respective doors to their respective second positions when said first and second members are moved to said extended positions.

12. The display of claim 8, further comprising a third member secured to said first housing for repetitive movement relative thereto, and a fourth member secured to said second housing for repetitive movement relative thereto, wherein said first drive means comprises a first bi-directional drive means for moving said first member to said extended position and said third member in said repetitive movement when said first drive means is operated in one direction and for moving said first member to said retracted position and said third member in said repetitive movement when said first drive means is operated in the other direction, and wherein said second drive means comprises a second bi-directional drive means for moving said second member to said extended position and said fourth member in said repetitive movement when said second drive means is operated in one direction and for moving said second member to said retracted position and said fourth member in said repetitive movement when said second drive means is operated in the other direction.

13. The display according to claim 12, wherein said second and fourth members comprise pendulums and wherein said repetitive movement comprises a repetitive swinging movement.

14. The display according to claim 7, wherein said second control signal activates said first and second drive means in a predetermined sequence whereby when said control unit is activated, one of said first and second members commences movement before the other.

15. The display of claim 1, wherein said control unit comprises a microprocessor.

16. The display of claim 15, wherein said means for storing said first and second pluralities of electric signals comprises an electronic memory.

17. The display of claim 16, further comprising:

means for outputting said first and second pluralities of electrical signals to said speaker in a predetermine sequence for generating a plurality of melodies;

means for activating and deactivating said control unit; and means for selectively accessing said microprocessor for generating a selected one of said plurality of melodies.

18. The display of claim 17, wherein said means for selectively accessing said storing means comprises a switch accessible by a user.

19. An ornamental action display comprising:

a control unit for generating a control signal;

a housing;

first and second members movably connected to said housing, said second member being visible to a person viewing said housing and said first member comprising a representation of a character;

bi-directional driving means coupled to said first and second members and responsive to said control signal for moving said second member in a repetitive motion and said first member to an extended position when said drive means is operated in one direction and for moving said second member in said repetitive motion and said first member from said extended position to a retracted position when said drive means is operated in the other direction.

20. The display of claim 19, wherein said housing defines a cavity, and wherein said first member is in said cavity in its retracted position.

21. The display of claim 20, wherein said second member comprises a pendulum, and wherein said repetitive motion comprises a repetitive swinging motion.

22. The display of claim 21, further comprising means for moving said first member in a repetitive motion when said first member is in its extended position.

23. The display of claim 22, wherein said housing defines an opening accessing said cavity, and further comprising a door hingedly secured to said housing for movement between a closed position wherein said opening is closed by said door and an open position wherein said opening is exposed, and wherein said first member moves said door to its open position when said first member is moved to its extended position.

24. The display of claim 23, wherein said housing comprises suspension means for suspending said housing from a Christmas tree and support means for alternatively supporting said housing on a flat surface.

25. The display of claim 24, wherein said support means is detachably secured to said housing.

26. The display of claim 23, further comprising sound generating means for generating a plurality of sounds having a common timbre corresponding to said character representation.

27. An ornamental musical action display comprising:

(A) a control unit including;

(1) a control circuit for generating first and second control signals;

(2) sound generating means electrically connected to said control circuit for generating sound in response to said first control signal, said sound generating means comprising (a) a speaker;

(b) a first plurality of electrical signals corresponding to a first plurality of sounds in a plurality of pitches, wherein a majority of said first plurality of sounds have a first timbre;

(c) a second plurality of electrical signals corresponding to a second plurality of sounds in a plurality of pitches, wherein a majority of said second plurality of sounds have a second timbre;

(d) means for storing said first and second pluralities of electrical signals;

(e) means for accessing said storing means for outputting said first and second pluralities of electrical signals to said speaker in a predetermined sequence for generating a melody;

(B) a first housing;

(C) a first member movably connected to said first housing and comprising a representation of a first character associated with said first timbre;

(D) A first pendulum pivotally secured to said first housing for swinging movement relative thereto;

(E) a first bi-directional driving means coupled to said first member and said first pendulum and responsive to said control signal for moving said first pendulum in a repetitive swinging motion and said first member to an extended position when said drive means is operated in one direction and for moving said first pendulum in said repetitive swinging motion and said first member from said extended position to a retracted position when said drive means is operated in the other direction;

(F) a second housing;

(G) a second member movably connected to said second housing and comprising a representation of a second character associated with said second timbre;

(H) a second pendulum pivotally secured to said second housing for swinging movement relative thereto; and (I) a second bi-directional driving means coupled to said second member and said second pendulum and responsive to said control signal for moving said second pendulum in a repetitive swinging motion and said second member to an extended position when said second drive means is operated in one direction and for moving said second pendulum in said repetitive motion and said second member from said extended position to a retracted position when said second drive means is operated in the other direction.

28. The display according to claim 27, wherein said sound generating means further comprises a third plurality of electrical signals corresponding to a third plurality of sounds in a plurality of pitches, wherein a majority of said third plurality of sounds have a third timbre, wherein said means for storing said first and second pluralities of electrical signals further comprises means for storing said third plurality of electrical signals, and wherein said means for accessing said storing means comprises means for accessing said storing means for outputting said first, second and third pluralities of electrical signals to said speaker in a predetermined sequence; and further comprising a third housing, a third member movably connected to said third housing and comprising a representation of a third character associated with said third timbre, and wherein said drive means is coupled to said first, second and third members and responsive to said second control signal for moving said first, second and third members comprising said first, second and third character representations relative to their respective housings, said second control signal being timed relative to said first control signal for generating said first, second and third pluralities of sounds in coordination with the movement of said first, second and third character representations, respectively.

29. The display of claim 28, wherein said means for accessing said storing means comprises means for accessing said storing means for simultaneously outputting at least two of said first, second and third pluralities of electrical signals to said speaker in a predetermined sequence whereby at least two of said first, second and third character representations appear to be singing simultaneously.

30. The display of claim 29, wherein said first plurality of electrical signals is outputted to said speaker only when said first character representation is in its extended position, wherein said second plurality of electrical signals is outputted to said speaker only when said second character representation is in its extended position, and wherein said third plurality of electrical signals is outputted to said speaker only when said third character representation is in its extended position.

31. The display of claim 30, wherein each of said first, second and third housings defines a cavity, and wherein each of said first, second and third members is received in the cavity in its respective housing in its retracted position.

* * * * *